US009194563B2

(12) United States Patent
Snyder

(10) Patent No.: US 9,194,563 B2
(45) **Date of Patent: *Nov. 24, 2015**

(54) INFLATABLE SOLAR POWERED LAMP

(71) Applicant: MPOWERD, Inc., New York, NY (US)

(72) Inventor: Jason Alan Snyder, Ridgewood, NJ (US)

(73) Assignee: MPOWERD Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/731,829

(22) Filed: Jun. 5, 2015

(65) Prior Publication Data

US 2015/0267900 A1 Sep. 24, 2015

Related U.S. Application Data

(63) Continuation of application No. 14/677,220, filed on Apr. 2, 2015, which is a continuation of application No. 13/926,336, filed on Jun. 25, 2013, now Pat. No. 9,016,886.

(60) Provisional application No. 61/721,285, filed on Nov. 1, 2012.

(51) Int. Cl.
*F21L 4/02* (2006.01)
*F21L 4/08* (2006.01)
(Continued)

(52) U.S. Cl.
CPC ..... *F21V 15/012* (2013.01); *F21L 4/08* (2013.01); *F21V 7/0075* (2013.01);
(Continued)

(58) Field of Classification Search
CPC ..... F21S 9/037; F21V 3/023; F21V 3/026; F21V 15/012; F21V 17/007; F21V 21/40; F21V 7/05; F21V 31/00; F21V 31/005; F21V 3/0436; F21V 7/0025; F21V 7/0033; F21V 7/0058; F21V 7/0066; F21V 7/0075; F21V 21/406; F21V 23/0414; F21Y 2101/02; F21Y 2105/001; F21Y 2113/005; F21L 4/02; F21L 4/027; F21L 4/08; F21L 2001/00; F21L 4/025
See application file for complete search history.

(56) References Cited

U.S. PATENT DOCUMENTS 5,782,552 A * 7/1998 Green ..... E01F 9/065 362/183
5,888,156 A 3/1999 Cmiel
(Continued)

FOREIGN PATENT DOCUMENTS

CA 152065 3/2014
CN 1162496 10/1997
(Continued)

OTHER PUBLICATIONS

Goering, Laurie, Blow-up solar lanterns lights up Haiti's prospects, Thomson Reuters Foundation, Jun. 22, 2012, http://www.trust.org/item/20120622150100-k9yos/.
(Continued)

*Primary Examiner* — Alan Cariaso
(74) *Attorney, Agent, or Firm* — Pearl Cohen Zedek Latzer Baratz LLP

(57) ABSTRACT

A solar powered lamp is provided with flat ends and a translucent flexible housing, such that the housing can be inflated to form a free standing cylinder. A solar panel faces outward on one of the flat ends for recharging a low-profile rechargeable battery which, under the control of a printed circuit panel, powers an array of LEDs, which point into the lamp housing. Reflective surfaces, facing each other on opposite inside end walls of the lamp, maximize the diffusion of light from the LEDs. The lamp is a durable, portable, long light lighting solution for those who live off the electric power grid, victims of disaster, and the like.

8 Claims, 2 Drawing Sheets

(51) Int. Cl.

| | |
|---|---|
| ***F21V 7/05*** | (2006.01) |
| ***F21V 31/00*** | (2006.01) |
| ***F21V 15/01*** | (2006.01) |
| ***F21V 7/00*** | (2006.01) |
| ***F21V 23/04*** | (2006.01) |
| ***F21V 21/40*** | (2006.01) |
| *F21V 1/00* | (2006.01) |
| *F21Y 105/00* | (2006.01) |
| *F21Y 113/00* | (2006.01) |

(52) U.S. Cl.

CPC ..... *F21V 21/406* (2013.01); *F21V 23/0414* (2013.01); *F21V 31/005* (2013.01); *F21L 4/025* (2013.01); *F21L 4/027* (2013.01); *F21L 2001/00* (2013.01); *F21V 7/0033* (2013.01); *F21V 7/05* (2013.01); *F21Y 2105/001* (2013.01); *F21Y 2113/005* (2013.01)

(56) References Cited

U.S. PATENT DOCUMENTS

| | | | | |
|---|---|---|---|---|
| 5,947,581 | A | 9/1999 | Schrimmer et al. | |
| 6,193,392 | B1 | 2/2001 | Lodhie | |
| 7,377,667 | B2 | 5/2008 | Richmond | |
| 7,690,812 | B2 | 4/2010 | Roberts | |
| 7,857,490 | B1 | 12/2010 | Fett | |
| 8,845,126 | B1 | 9/2014 | Martzall | |
| 9,016,886 | B2 * | 4/2015 | Snyder | 362/183 |
| 2005/0265029 | A1 | 12/2005 | Epstein et al. | |
| 2006/0108612 | A1 * | 5/2006 | Richmond | 257/222 |
| 2006/0291217 | A1 * | 12/2006 | Vanderschuit | 362/363 |
| 2007/0014125 | A1 | 1/2007 | Chu | |
| 2008/0013317 | A1 | 1/2008 | Hinds | |
| 2008/0175006 | A1 | 7/2008 | Kellman et al. | |
| 2011/0018439 | A1 | 1/2011 | Fabbri | |
| 2012/0120642 | A1 | 5/2012 | Sreshta | |
| 2012/0193660 | A1 | 8/2012 | Donofrio | |
| 2012/0224359 | A1 | 9/2012 | Chun | |
| 2014/0049942 | A1 * | 2/2014 | Chilton | F21L 4/00 362/96 |

FOREIGN PATENT DOCUMENTS

| | | |
|---|---|---|
| CN | 101576204 | 11/2009 |
| CN | 101690402 | 3/2010 |
| CN | 102116415 | 9/2010 |
| CN | 201010228234.3 | 11/2010 |
| CN | 201715273 | 1/2011 |
| CN | 102403929 | 11/2011 |
| CN | 202203682 | 4/2012 |
| CN | 202511013 | 10/2012 |
| CN | 202884514 | 4/2013 |
| CN | 203215307 | 9/2013 |
| CN | 203489018 | 3/2014 |
| CN | 302782955 | 3/2014 |
| DE | 10 2006 022185 | 11/2007 |
| EP | 002289363 | 8/2013 |

OTHER PUBLICATIONS

Patent Evaluation report for Chinese Patent Application No. ZL201320570977.8 dated Feb. 26, 2014.

Jesper, Jonsson, "Project Soul Cell", YouTube (Oct. 28, 2009), http://www.youtube.com/watch?v=DG7lkgUUr4M.

European Search Report dated Sep. 23, 2015, European Pat. Appl. No. 13851862.6, pp. 1-5.

* cited by examiner

INFLATABLE SOLAR POWERED LAMP

CROSS-REFERENCE TO RELATED APPLICATIONS

This application claims the benefit of U.S. patent application Ser. No. 14/677,220, filed Apr. 2, 2015, which is a continuation of U.S. patent application Ser. No. 13/926,336, filed Jun. 25, 2013, which claims the benefit of U.S. Provisional Application No. 61/721,285, filed Nov. 1, 2012, all of which are incorporated by reference in their entirety.

BACKGROUND OF THE INVENTION

1. Field of the Invention

The invention is in the field of solar powered lighting devices. Specifically, the disclosure pertains to an inflatable, collapsible solar powered lamp, which provides low cost lighting to people with unreliable access to electric power, including populations in the developing world and victims of disaster. The unit may also be used throughout the developed world as an energy-efficient, green portable lighting alternative.

2. Description of the Related Art

US 2012/0120642 to Shreshta and US 2012/0224359 to Chun are published U.S. applications directed to an inflatable solar light. The disclosed device has an inconvenient shape and lacks effective light-diffusing capabilities.

SUMMARY OF THE INVENTION

Thus, in one aspect, the invention is a collapsible solar powered lantern, comprising: a collapsible lantern housing; a solar panel; a rechargeable lithium-ion battery; LED lights; and a circuit board. The rechargeable battery is recharged by laying the collapsible lantern housing in direct sunlight for 4 to 5 hours for complete charging.

In embodiments, the lantern is in the form of a lamp having a collapsible, translucent housing with flat circular end walls and a side wall. In this way, the lamp can be laid on its side so that it forms a free-standing cylinder shape when expanded. A valve is provided for inflating the collapsible housing. A planar array of light emitting diodes (LEDs) is arranged on a printed circuit board on one end wall. The printed circuit board is operatively connected to a rechargeable battery powering the LEDs; a solar panel adapted to recharge the rechargeable battery; and a switch for powering the LEDs on and off. In preferred embodiments, reflective surfaces on the end walls face each other to increase the diffused light from the device.

DETAILED DESCRIPTION OF THE INVENTION

Figure 1A:
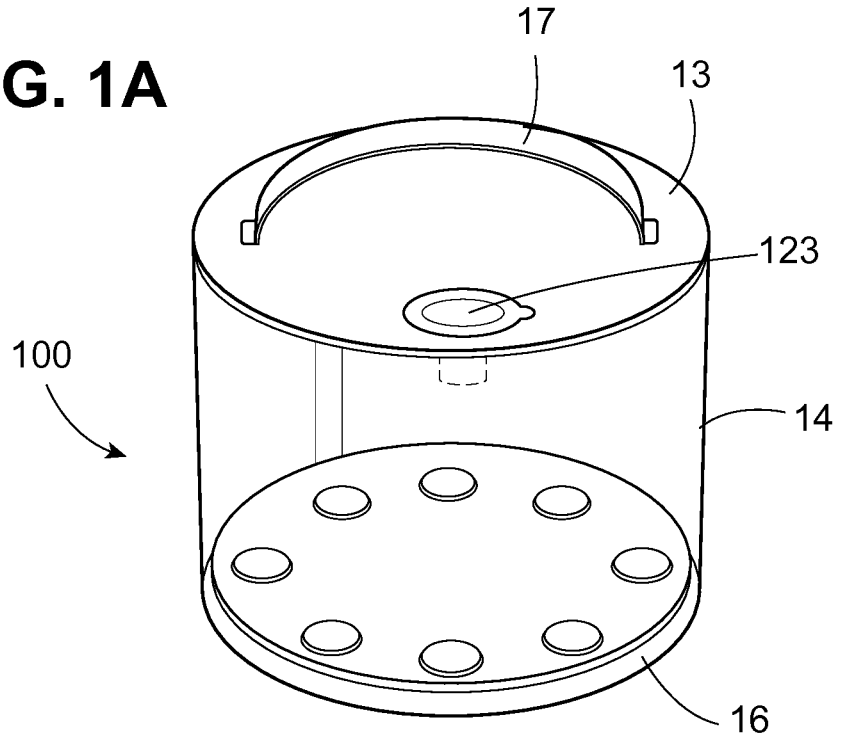
FIG. 1A is a perspective view of a solar powered lamp according to the invention.
Figure 1B:
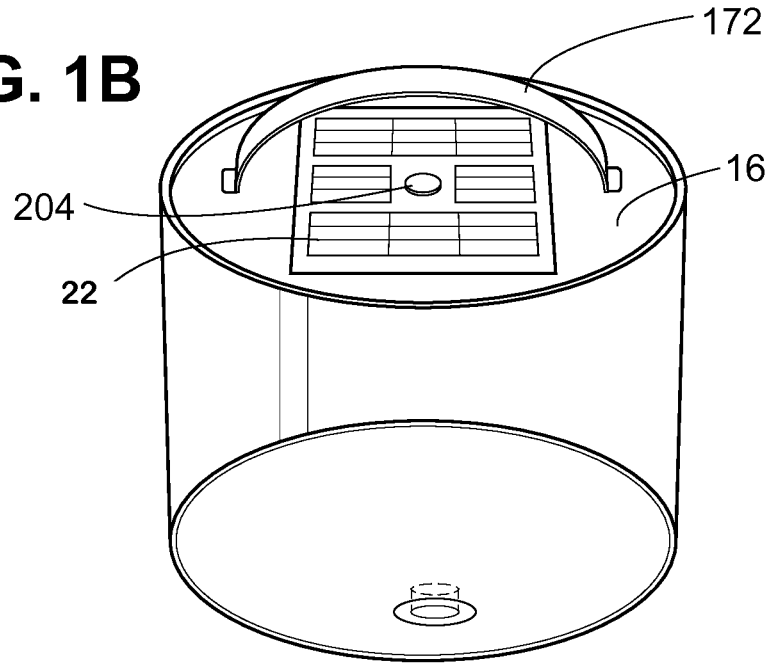
FIG. 1B is a perspective view of the solar powered lamp of FIG. 1A from the bottom side.

Referring to the embodiment of FIG. 1A, collapsible housing 100 is made from a translucent, and preferably clear, plastic material such as polyvinylchloride (PVC), although the material used is not critical and another suitable translucent and flexible material, such as polyethylene, could be used. Housing 100 includes cylindrical side wall 14, flat circular top end wall 13, and flat circular bottom end wall 16. The flat end walls are sufficiently rigid to enable the lamp to form a free-standing cylinder when expanded. A handle 17, also preferably made out of the same flexible plastic material as the housing, permits the lamp to be attached easily to a wall or ceiling, or be to carried as the need arises. In the most preferred embodiments, a second handle 172 is provided on the opposite end wall 16, as shown in FIG. 1B.

Figure 2:
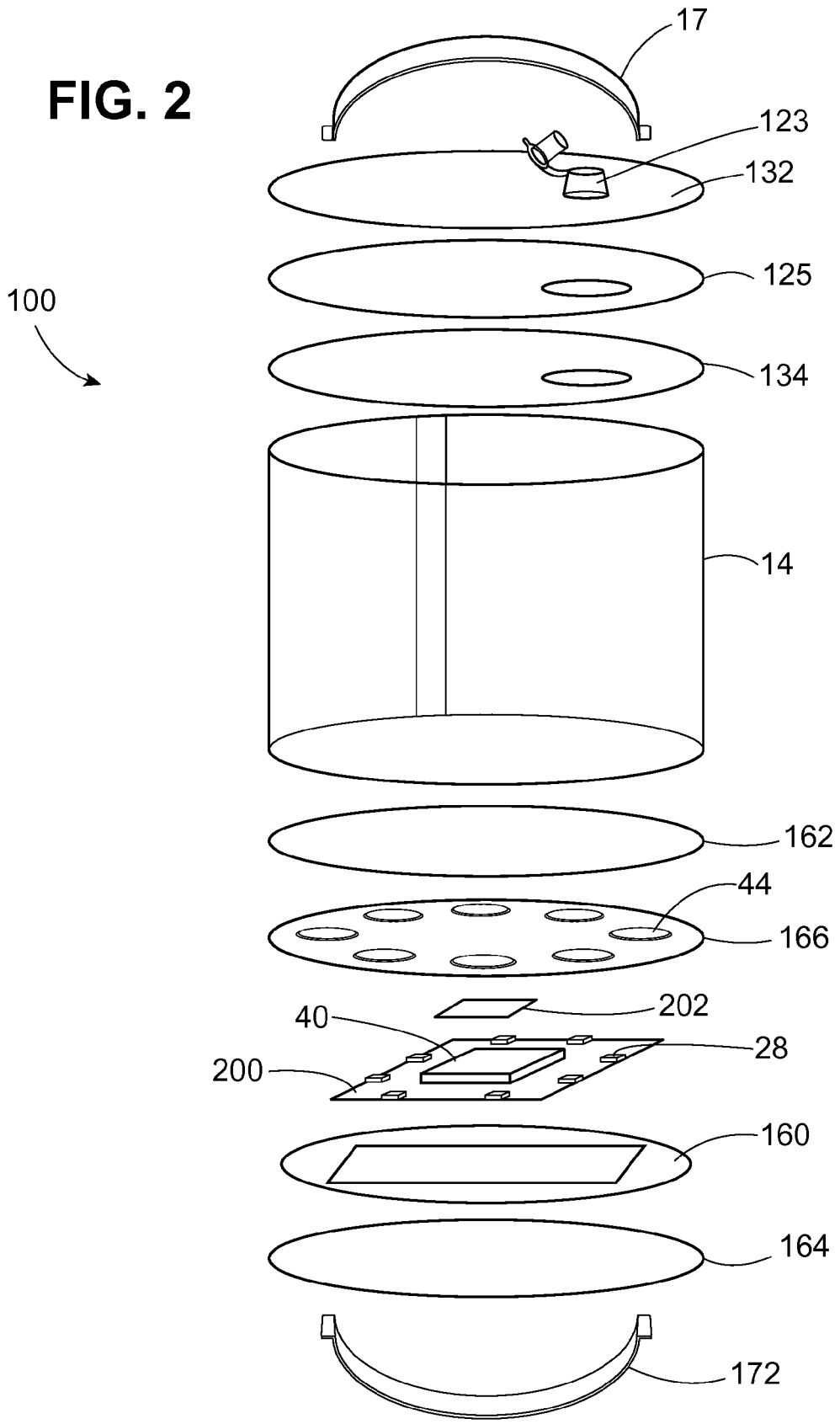
FIG. 2 is an exploded view of the solar powered lamp of FIG. 1A.

As shown in the exploded view of FIG. 2, top end wall 13 preferably includes an inner top 134 and outer top 132. Bottom end wall 16 includes inner bottom 162 and outer bottom 164. The inner and outer top (132, 134) are sealed to the side wall 14 and to each other to enclose top reflector 125 in water-tight fashion. It is generally preferable that the housing be sealed to an ingress protection level known as IP 67, which means protected against the ingress of dust and contaminants, and against the effects of temporary immersion in between 15 cm and 1 m of water for 30 minutes. Top reflector 125 has a reflective surface directly facing the LEDs 28 positioned on the bottom end wall and may be made out of PVC plated with a reflective coating, cardstock with a reflective coating, or other suitable material to provide stiffness to the housing end wall 13, and also to reflect light from the LEDs 28.

A similar arrangement is provided on the bottom end wall 16, with bottom reflector 166 formed of a reflective-coated material. The bottom reflector is provided with apertures 44 positioned over the LED lights 28. Apertures 44 may be provided with a diffusive scrim material to close off the openings.

LED lights 28 are in turn provided on a printed circuit board 200 on an end wall of the device. A rechargeable battery 40, adapted to power the LEDs, is provided on the printed circuit board 200 opposite a solar panel 22 (shown in FIG. 1B) adapted to recharge the rechargeable battery 40. The solar panel is exposed to the sunlight through the clear outer bottom 164 through an aperture in bottom frame 160. The printed circuit board is attached to bottom frame member 166 with double sided tape 202.

A solar panel for use with the invention may be selected from those known in the art to be adapted to power a small LED array. A suitable solar panel is a polycrystalline 5V/130 mA array with an open circuit voltage of 4.3 V, a short circuit current of about 3.5 A, and an optimum operating voltage of 2.6 V. Generally, when the solar panel is laid flat in direct sunlight, the rechargeable battery is completely charged in 4 to 8 hours, with sufficient charge to yield more than 6 hours of light and preferably more than 8 hours of light once fully charged. Although any number of LEDs may be used within the scope of the invention, 6 to 10 LEDs is preferable, and 8 is most preferred. The LEDs provide a 4000 mcd light source, sufficient to illuminate a 10 square foot area with usable lighting. In embodiments, multicolored LEDs may be used. Use of multicolor LEDs may be functional, such as red or yellow to indicate emergency condition, or decorative.

The rechargeable battery 40 is preferably a lithium-ion polymer battery with a thin profile that can be readily incorporated onto a printed circuit board. In the most preferred embodiments, the rechargeable battery has a thickness of no more than about 5 mm, a capacity of 1000 mAh, and a nominal operating voltage of 3.7 V. wherein the planar array of LEDs consists of eight LEDs arranged in a circle and powered by the battery. In a preferred embodiment, each LED has a maximum operating current of 320 mA at 90 lumens (high power) and 220 mA at 70 lumens (low power).

The printed circuit board 200 controls the powering of the LEDs by the battery 40. A user activates a power switch 204 located on the exterior of the lamp to power the LEDs. In embodiments, the circuit board controls three levels of illumination: low power, high power and intermittent. The levels can be obtained by pressing the same power switch used to turn the device off and on. For example, the switch may be pressed once for low power, twice for high power, three times for intermittent, and four times to turn the device off. Sourcing a suitable such microchip for this purpose may be left to the skill of the ordinarily skilled artisan.

The housing is collapsible and is preferably inflatable through a valve 123 through the top end wall 13. Apertures are provided in the top reflector and inner top into the interior of the housing so that the housing can be inflated, resulting in a low-cost, lightweight and durable lighting solution for those in need.

The above description of the preferred embodiments is not to be deemed limiting of the invention, which is defined by the following claims. The foregoing description should provide the artisan of ordinary skill with sufficient information to practice variants of the embodiments described. Features and improvements described in connection with one embodiment may be combined with other embodiments without departing from the scope of the invention.

The invention claimed is:

1. A solar powered lamp, comprising:

a collapsible, translucent housing having flat end walls and a side wall;

a water-tight seal between the flat end walls and the side wall;

wherein each flat end wall comprises an inner end wall, an outer end wall and a rigid panel sealed between the inner end wall and the outer end wall;

a printed circuit board on one end wall comprising a planar array of light emitting diodes (LEDs);

a reflective surface on one of the flat end walls having apertures positioned over the planar array of LEDs;

a rechargeable battery attached to the printed circuit board powering the LEDs;

a solar panel on the printed circuit board opposite the array of LEDs adapted to recharge the rechargeable battery; and the circuit board being operatively connected to the rechargeable battery, the LEDs, the solar panel, and a switch for powering the LEDs on and off.

2. The solar powered lamp according to claim 1, further comprising a valve for inflating the lamp.

3. The solar powered lamp according to claim 1, further comprising planar reflective panels covering substantially the entire surface area of each end wall.

4. The solar powered lamp according to claim 1, wherein the housing is clear and sealed to be water-tight.

5. The solar powered lamp according to claim 1, wherein the switch powers the LEDs between different modes selected from the group consisting of a high power mode, a low power mode, and a blinking mode.

6. The solar powered lamp according to claim 1, wherein the LEDs are multicolored.

7. The solar powered lamp according to claim 1, wherein the battery is a lithium ion polymer battery pack having a thickness less than 5 mm.

8. The solar powered lamp according to claim 1, further comprising a handle attached to one or both flat ends.

* * * * *